US006231000B1

(12) United States Patent
Wood

(10) Patent No.: US 6,231,000 B1
(45) Date of Patent: May 15, 2001

(54) VERTICAL TOILET TISSUE DISPENSER AND CONVERTIBLE WALL MOUNT

(76) Inventor: Benjamin D. Wood, 17501 Panama City Beach Pkwy., Panama City Beach, FL (US) 32413

( * ) Notice: Subject to any disclaimer, the term of this patent is extended or adjusted under 35 U.S.C. 154(b) by 0 days.

(21) Appl. No.: 09/410,980

(22) Filed: Oct. 1, 1999

Related U.S. Application Data

(63) Continuation-in-part of application No. 09/109,399, filed on Jul. 2, 1998, now abandoned.
(60) Provisional application No. 60/057,481, filed on Sep. 3, 1997.

(51) Int. Cl.[7] ..... B65H 16/04
(52) U.S. Cl. ..... 242/597.7; D6/521
(58) Field of Search ..... 242/597.7, 597.8; D6/521, 523

(56) References Cited

U.S. PATENT DOCUMENTS 1,224,106 * 4/1917 Good .
3,370,805 * 2/1968 Barbee .
3,407,980 * 10/1968 Addison .
3,806,055 * 4/1974 Bauman .
3,844,500 * 10/1974 Krause .
4,074,872 * 2/1978 Marqhall .
4,248,391 * 2/1981 Ness .
4,373,682 * 2/1983 Dickson .
5,170,956 * 12/1992 McTaggart .
5,297,749 * 3/1994 White .
5,704,565 * 1/1998 Cheng .

* cited by examiner

*Primary Examiner*—John Q. Nguyen
(74) *Attorney, Agent, or Firm*—William B. Noll

(57) ABSTRACT

A convertible, vertically disposed dispenser for dispensing toilet tissue from a roll. The dispenser is adapted to be attached to a conventional horizontally disposed toilet tissue dispenser by a fastening mechanism which includes a rotatable, elongated threaded member mounting a movable plate for engagement with the spindle of the horizontally disposed toilet tissue dispenser. Further, the convertible dispenser mounts a vertically oriented spindle for receiving and dispensing a roll of toilet tissue.

8 Claims, 3 Drawing Sheets

VERTICAL TOILET TISSUE DISPENSER AND CONVERTIBLE WALL MOUNT

RELATED APPLICATION

This application is a continuation-in-part of Ser. No. 09/109,399, filed Jul. 2, 1998, abandoned, which in turn is a continuation of Provisional Application, Ser. No. 60/057,481, filed Sep. 3, 1997, all under the same title and by the inventor hereof.

FIELD OF THE INVENTION

The present invention relates to vertically disposed paper roll dispensers. More specifically, the present invention relates to a convertible device which is intended to dispense toilet paper rolls.

BACKGROUND OF THE INVENTION

In general, the use of vertically disposed spindles to hold toilet paper rolls commends itself because it is much easier to replace depleted rolls of paper than in the case of devices of the same sort having the traditional horizontally disposed spindles. As a rule, horizontally disposed spindles require both ends to be securely ensconced in holding devices so that the paper roll will not rotate off the spindle in the course of being unfurled. Consequently, horizontally disposed devices require a rather cumbersome procedure to replace depleted rolls of paper, since the spindle itself must first be detached from its associated holding devices, and then reattached after being inserted into the core of a fresh roll of paper. As a result, devices of this type often fall into disuse, and toilet paper rolls instead stand about freely in the bathroom and cause a cluttered appearance. Moreover, the surfaces on which toilet paper rolls are placed in these circumstances tend to be wet, and thus many rolls of toilet paper are damaged or ruined owing simply to the difficulty associated with mounting them to the standard horizontal dispenser.

Vertically disposed dispensers, on the other hand, do not require the top portion of the spindle to be secured in a holding device in order to effectively contain the roll to the spindle as it is being unfurled. For this reason, vertically disposed spindles offer a general advantage over horizontally disposed ones in that rolls of toilet paper or other material may be instantly removed and installed over the top end of the vertical spindle. Such a convenience will encourage people to make use of the dispenser, thus avoiding the previously described problems associated with horizontal dispensers.

Many of the vertically disposed paper dispensers disclosed in the prior art do not fully exploit the potential convenience offered by their 25 vertical disposition because they fail to include a means whereby the roll is securely confined to the spindle body in the course of being unfurled. Such a means is of particular neccessity in the case of vertical toilet paper dispensers, because a person generally reaches down from above the dispenser to dispense toilet paper. As a consequence, the roll will have a tendency to rotate up and off of the spindle, in the direction in which it is being pulled. To overcome this difficulty one of the points of novelty of the present invention is the inclusion of a specially designed retaining flange attached to the spindle top which functions to retain the roll while being unfurled from above, but without impeding its easy removal and installation.

Previously disclosed paper roll dispensers include U.S. Pat. No. 1,224,106, granted to Good; U.S. Pat. No. 3,370, 805, granted to Barbee; U.S. Pat. No. 3,407,980, granted to Addison; U.S. Pat. No. 3,806,055, granted to Bauman; U.S. Pat. No. 3,844,500, granted to Krause; U.S. Pat. No. 4,074,872, granted to Marshall, Jr; U.S. Pat. No. 4,248,391, granted to Ness; U.S. Pat. No. 4,373,682, granted to Dickson; U.S. Pat. No. 5,170,956, granted to McTaggart; U.S. Pat. No. 5,297,749, granted to White; and U.S. Pat. No. 5,704,565, granted to Cheng. A consideration of these patents reveals three devices which incorporate structural elements at the top of the dispensing spindle functioning to retain the top of the roll to the spindle. The first of these is U.S. Pat. No. 3,806,055, one embodiment of which discloses the addition of a relatively wide diameter disk included on the spindle top to retain the paper roll. The second is U.S. Pat. No. 5,297,749, which discloses a vertically disposed paper roll holder whose spindle includes a top portion which may be screwed onto the top of the spindle and which has two small oppositely placed horizontal bars projecting radially outward intended to confine the roll to the bar. The last of these is U.S. Pat. No. 5,704,565, which discloses a vertically oriented tissue dispensing spindle, having a storage shelf for a spare roll of toilet tissue. The dispenser mounts on the horizontal spindle of a conventional dispenser and is stabilized against the base of the conventional dispenser.

In the case of the latter developments, however, the outer limit of the retaining devices extends radially beyond the radius of the paper roll core, thus necessitating the removal of the retaining devices from the spindle in order to remove a spent roll and insert a new one. As a result, one of the primary advantages of a vertically disposed device—namely, that it preclude the encumbrances inherent in horizontally disposed devices relating to roll removal and insertion—is vitiated. The present invention remedies this defect by providing a modified spindle top whose diameter widens slightly in relation to the diameter of the spindle body below it so as to retain the paper roll during the act of unfurling, but whose maximum diameter is less than the diameter of toilet paper roll core so as to permit single-step procedures to insert and remove rolls.

The prior art also fails to describe an adaptor for convertibly mounting the device to previously installed horizontal toilet paper dispensers. Such horizontal dispensers are often structures made of ceramic or the like and permanently mounted to the bathroom wall. It is generally not easily possible to remove such a dispenser without substantially altering the bathroom itself An alternative means of dealing with the presence of the horizontal dispenser is to incorporate its structure into that of the vertical dispenser, both for aesthetic reasons and for the sake of saving wall space. This incorporation of structure can be achieved through use of the adaptor kit herein disclosed. In addition, the adaptor kit offers the possibility of using the horizontal dispenser to provide structural support for the vertical dispenser.

An added problem attends the use of the replacement dispensers in bathrooms with tiled walls, since this type of decor does not lend itself to the use of screws or other surface-penetrating fasteners to secure the replacement dispenser. The use of the adaptor kit disclosed herein, however, requires no tools, drilling, or surface-penetrating fasteners, and can be adjusted to fit almost any existing toilet paper dispenser of horizontal disposition. For all these reasons, the adaptor kit herein disclosed has a particular pertinence to the structure of many bathrooms currently in use.

While several of the devices in patents cited above include specific mounting adaptations, only three of these devices disclose adaptations whose purpose somewhat resembles the apparatus proposed herein. The first, disclosed in U.S. Pat. No. 3,844,500, comprises a shelf intended to dispense paper towels in a vertically disposed fashion, with an adaptation allowing it to be mounted to horizontally disposed towel racks and the like. A second device, disclosed in U.S. Pat. No. 5,297,749, discloses a vertical roll holder which includes a clip allowing the device to be clipped to the bars of a hospital bed. The last device, disclosed in U.S. Pat. No. 5,704,565, incorporates a guide tube containing a brace and spring as a pressure stabilizing means. While the function of the adaptor associated with the present invention may appear similar to the mounting adaptations just cited, the structure of the adaptor kit herein disclosed differs considerably, and will be seen to constitute a further point of novelty in the present invention.

By virtue of the distinct character both of the retaining flange and the horizontal spindle adaptor described herein, none of the above inventions and patents, taken either singlely or in combination, is seen to describe the present invention as claimed.

The distinct character of the present invention will become apparent to those skilled in the art from the following description, particularly when read in conjunction with the accompanying drawings.

SUMMARY OF THE INVENTION

This invention is directed to a vertically disposed dispenser for dispensing toilet tissue from a roll, for use with a supporting wall and a conventional, horizontally disposed toilet tissue dispenser attached to the wall. The horizontal dispenser includes two spindle receiving arms, each attached to the wall, and a horizontal spindle, where the spindle is rotatably suspended at its ends from the spindle receiving arms. The vertical dispenser comprises a molded housing defined by an outer face, and a cavity extending inwardly from a rear, continuous planar edge, where the cavity is sized to overlie the horizontally disposed toilet tissue dispenser and to allow the rear, continuous planar edge to abut the supporting wall. The outer face includes a concave rear surface and a horizontal platform extending forwardly from the rear surface, where the platform includes an essentially vertical peripheral wall, a first, vertically oriented, centrally disposed aperture along the platform, and a second, horizontally oriented aperture along the peripheral wall. Further, a fastening mechanism is positioned within the cavity and extends between the second aperture and the wall, where the fastening mechanism includes an elongated threaded member mounted for rotative movement at its respective ends, and includes a movable plate therealong for engagement with the horizontal spindle when the threaded member is rotated. Finally, a vertically oriented spindle is secured through the first aperture into contact with the fastening mechanism.

Accordingly, an object of this invention is to provide a simple, yet effective, means for mounting the vertical dispenser in such a manner as to make use of the wall space allotted to a previously mounted, non-removable horizontal dispenser.

Another object hereof is to provide means whereby the dispenser may be mounted without the need to make defacing holes or slots in the supporting wall.

Still a further object of the invention is to provide improved elements and arrangements thereof in a device for the purposes described which is inexpensive, dependable and fully effective in accomplishing its intended purposes.

These and other objects of the invention will become readily apparent upon further review of the following specification and accompanying drawings.

DETAILED DESCRIPTION OF THE PREFERRED EMBODIMENT

Figure 1A:
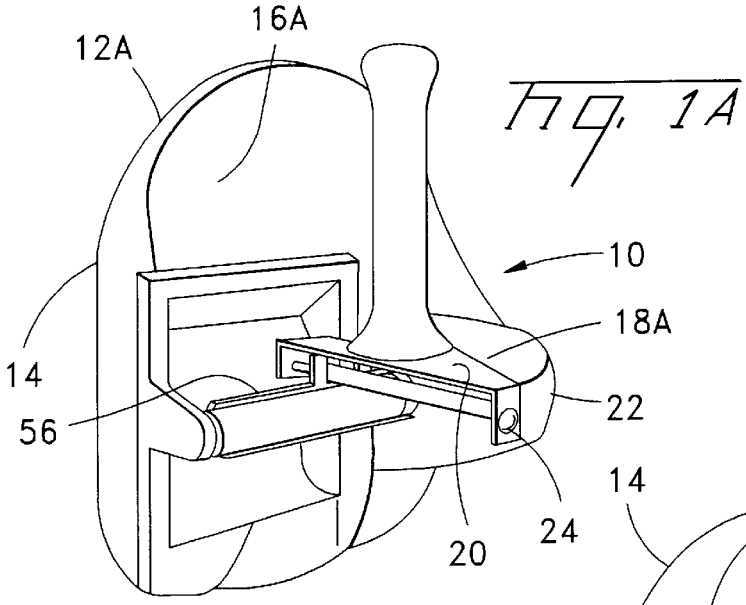
FIGS. 1A–1C are perspective views, illustrating three design versions for a molded housing and outer face, with hidden parts shown in phantom, of the vertical toilet tissue dispenser and convertible wall mount according to this invention.

This invention is directed to a vertically disposed toilet tissue dispenser, and a convertible device for convertibly mounting same to a conventional, horizontally disposed toilet tissue dispenser attached to a wall by a pair of spindle receiving arms and spindle. The device will now be described with regard to the several Figures, where like reference numerals represent like components or features throughout the several views.

Figure 1B:
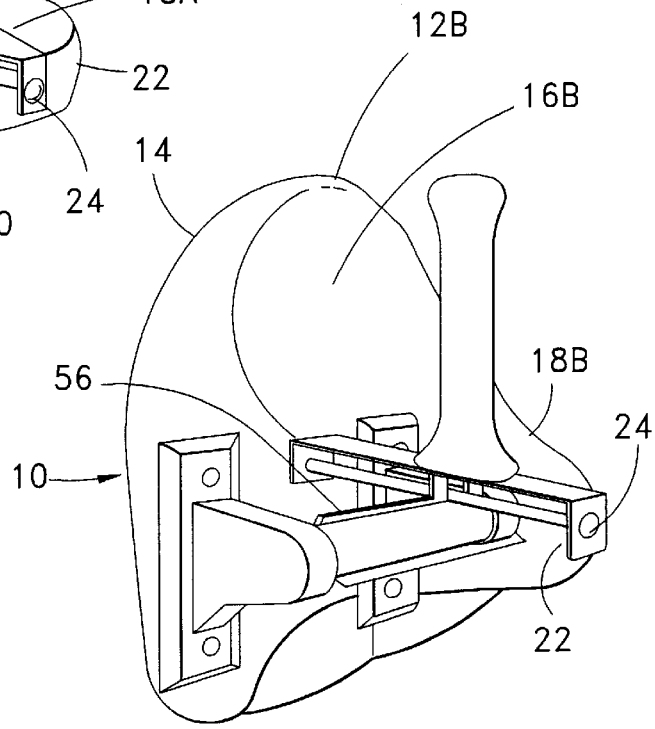
Figure 1C:
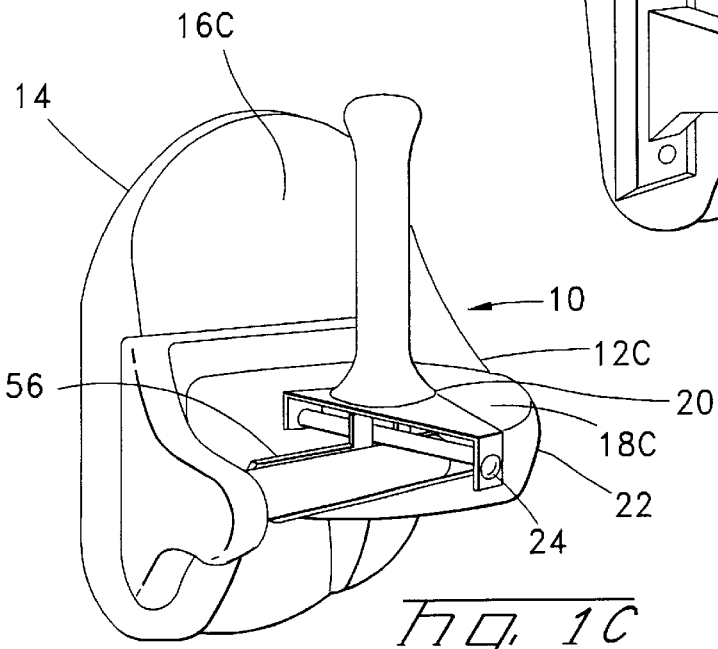

Turning now to FIGS. 1A–1C, the device 10 hereof comprises a thin-walled molded housing 12A, 12B and 12C, preferably molded of plastic, having a rear cavity, not shown, of a size to receive the conventional, horizontally disposed toilet tissue dispenser attached to a supporting wall, as known in the art. The rear cavity terminates in a continuous, planar edge 14 that in the assembled and operative mode abuts the supporting wall, not shown. Externally, the respective housings feature a concave rear face 16A, 16B and 16C extending above a horizontal platform 18A, 18B and 18C, where the said platforms include a central opening 20, the purpose of which will be explained later. The respective platforms are further defined by a peripheral, vertical wall 22 having a forward central aperture 24, the function of which will become apparent hereafter.

Figure 2:
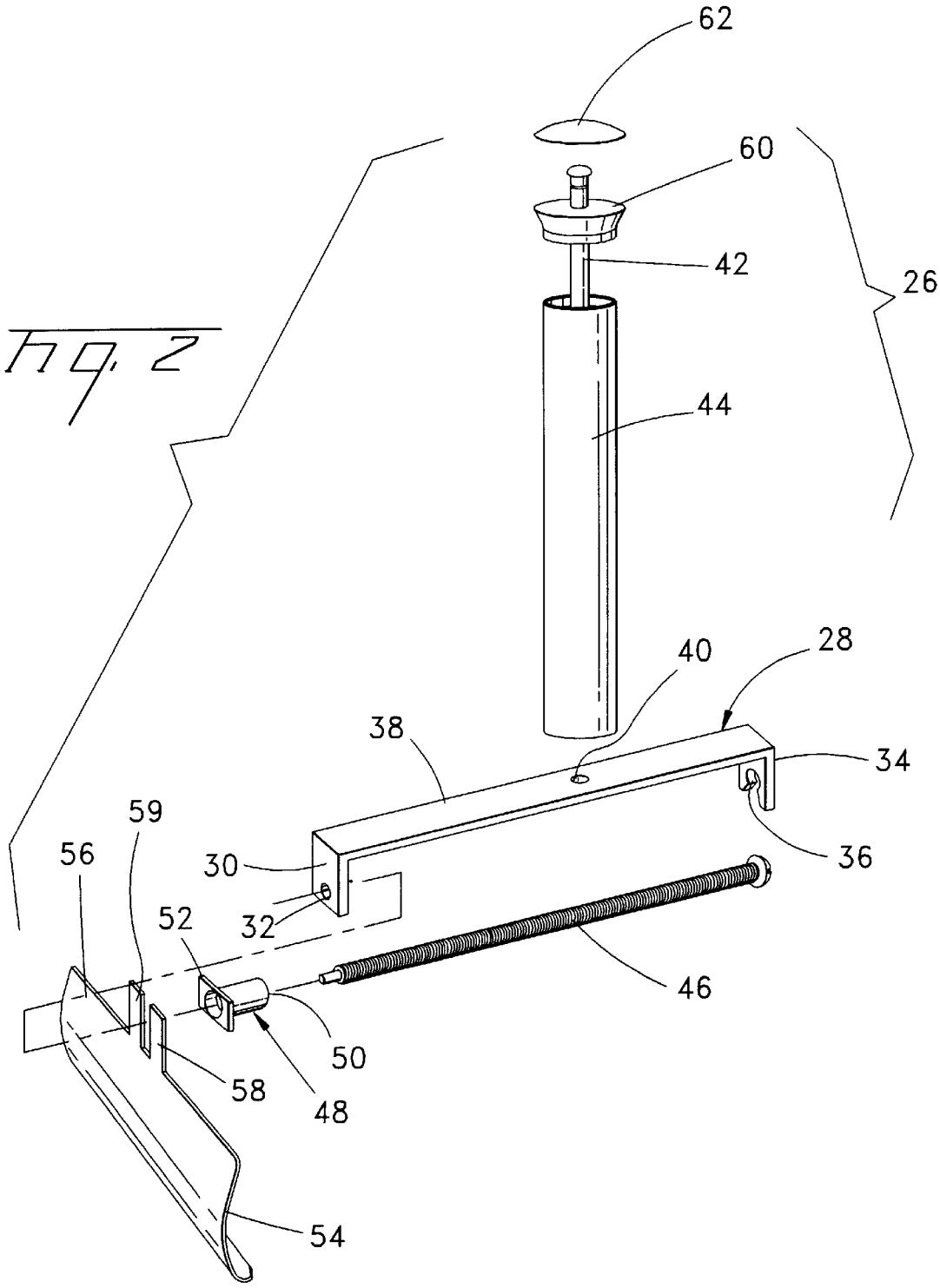
FIG. 2 is an exploded perspective view of the wall mounting mechanism and vertical spindle for the respective molded housings of FIGS. 1A, 1B and 1C.
Figure 3B:
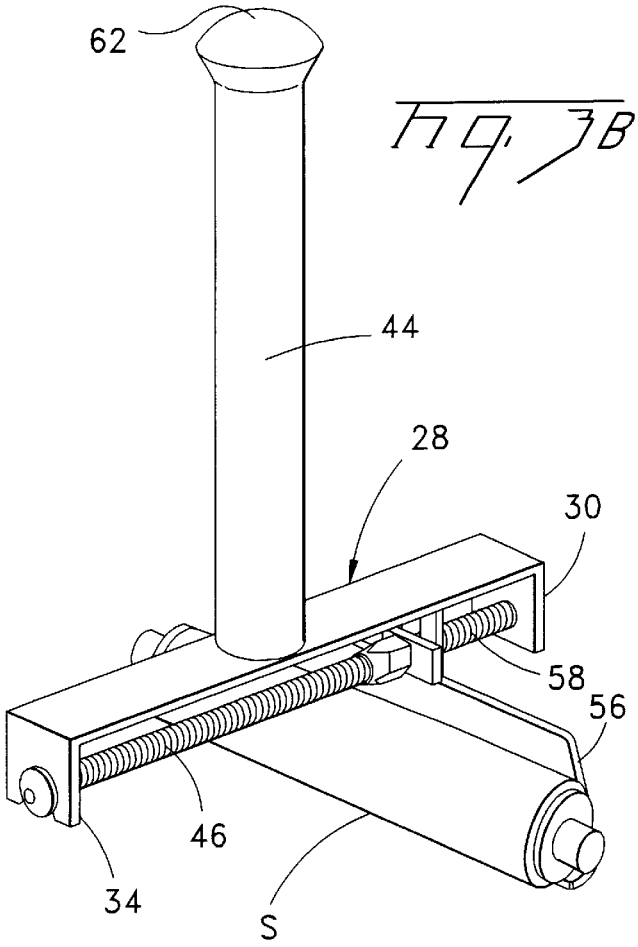
FIGS. 3A and 3B, respectively, are front and rear perspective views of the wall mounting mechanism and vertical spindle of FIG. 2.
Figure 3A:
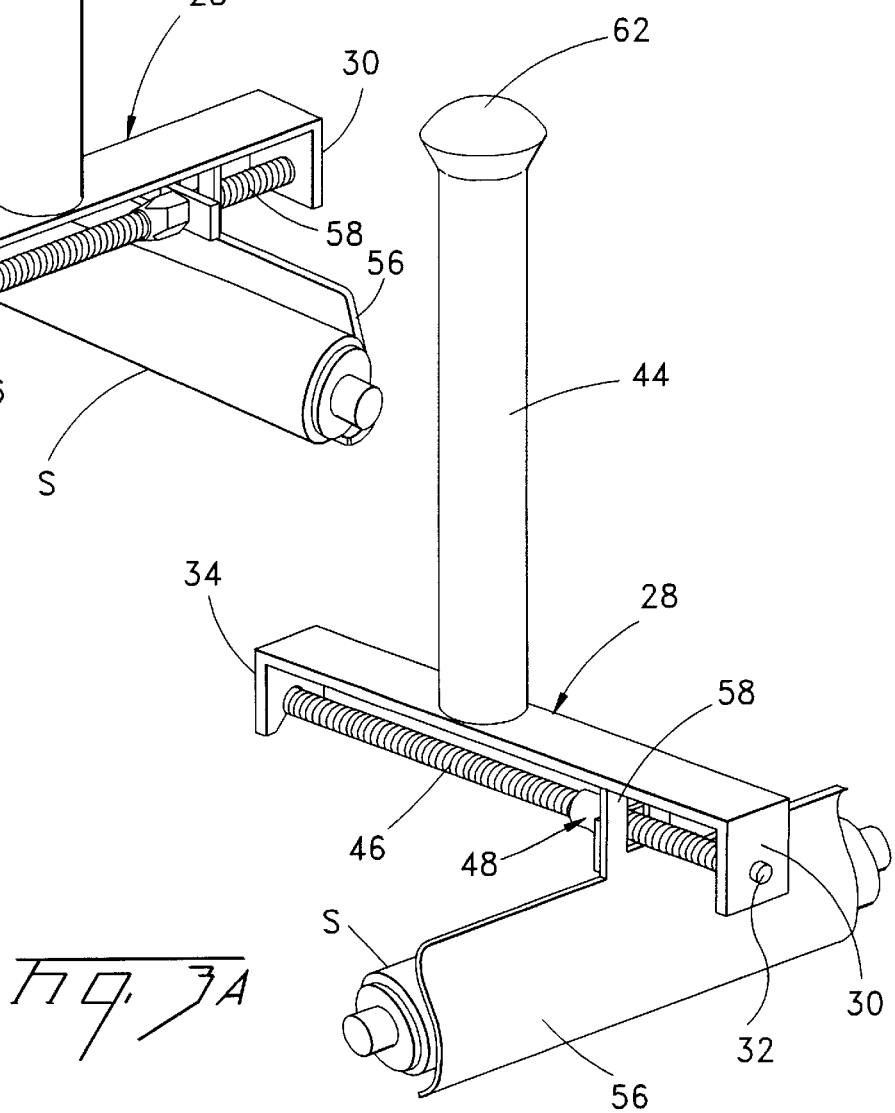

The attachment mechanism, as shown in exploded fashion in FIG. 2, comprises an elongated U-shaped bracket 28, where a first free leg 30 includes an opening 32, and the opposite free leg 34 preferably includes a slot 36, but may be an aperture, if desired. The base 38 includes a threaded opening 40 for receiving a complementary elongated member 42 to mount the spindle 44.

Mounted for rotational movement between the respective free legs 30, 34 is an alongated threaded rod 46, where said rod receives T-member 48. The T-member comprises an internally threaded sleeve 50 and a flanged end 52, which cooperates with an arcuate shaped member 54 to removably secure the attachment mechanism 26 to the conventional, horizontally disposed spindle "S". The arcuate shaped member 54 features an upper edge 56 from which a pair of parallel arms 58 extend upwardly. The arms are spaced apart to define a slot 59 to receive the threaded sleeve 50. Thus, as the threaded rod 46 is rotated cause the threaded sleeve 50 to move axially, like a worm gear, the arcuate shaped member 54 may be moved into or away from engaging contact with the conventional, horizontally disposed spindle "S". By shaping the arcuate member in the complementary fashion shown, a temporary but fixed relationship is established between the conventional spindle "S" and the arcuate member 54.

With a respective said housing 12A, 12B, or 12C positioned over the attachment mechanism 26, and temporarily fixed thereto, such as by a conventional screw driver (not shown) extending through the central aperture 24 into rotating contact with the complementary elongated member 42, by slot means known in the art, the device 10 may be secured to the supporting wall. When the respective components are firmly secured to the supporting wall, the central platform opening 20 is aligned with threaded opening 40. In this aligned position, the spindle receiving elongated member 42, mounting a spindle 44 may be threadably engaged with threaded opening 40 to further stabilize the housing and the attachment mechanism. To provide a more aesthetic appearance to the spindle 44, and to easily and quickly replace a roll of toilet tissue, one or a pair of threaded cap members 60, 62 may be provided.

It should be recognized that variations, modifications and changes may be made to the device of this invention, particularly by those skilled in the art, within the scope of this invention. Accordingly, no limitation is intended to be imposed thereon except as set forth in the appended claims.

What is claimed is:

1. A vertically disposed dispenser for dispensing toilet tissue from a roll, for use with a wall and horizontally disposed toilet tissue dispenser attached to said wall, said horizontal dispenser including two spindle receiving arms, each attached to said wall, and a horizontal spindle, said horizontal spindle being rotatably suspended at the ends of the spindle from said spindle receiving arms, said vertical dispenser comprising:

a.) a molded housing defined by an outer face, and a cavity extending inwardly from a rear, continuous planar edge, where said cavity is sized to overlie said horizontally disposed toilet tissue dispenser and to allow said rear, continuous planar edge to abut said wall, i.) said outer face including a concave rear surface and a horizontal platform extending forwardly from said rear surface, where said platform includes an essentially vertical peripheral wall, and ii.) a first, vertically oriented aperture centrally disposed along said platform, and a second, horizontally oriented aperture along said peripheral wall;

b.) a fastening mechanism positioned within said cavity and extending essentially between said second aperture and said wall, where said fastening mechanism includes an elongated threaded member mounting a movable plate therealong for engagement with said horizontal spindle when said threaded member is rotated; and c.) a vertically oriented spindle secured through said first aperture into contact with said fastening mechanism.

2. The vertical dispenser according to claim 1, wherein said elongated threaded member engages an internally threaded sleeve member, where said sleeve member mounts a flange engaging said movable plate.

3. The vertical dispenser according to claim 2, wherein said movable plate includes an elongated member having an upstanding extension, where said extension includes a slot for engaging said sleeve.

4. The vertical dispenser according to claim 3, wherein said horizontal spindle is cylindrically shaped, and said elongated member is comparably curved to engage said horizontal spindle.

5. The vertical dispenser according to claim 1, wherein said fastening mechanism includes a U-shaped bracket having a pair of parallel end legs, where said legs are disposed, respectively, in close proximity to said wall and said second aperture.

6. The vertical dispenser according to claim 5, wherein said elongated threaded member extends between said parallel end legs.

7. The vertical dispenser according to claim 1, wherein said elongated threaded member is mounted for rotative movement in said parallel end legs.

8. The vertical dispenser according to claim 1, wherein said vertically oriented spindle is uniformily spaced from said concave rear surface so as to receive and dispense said roll of toilet tissue.

* * * * *